US011087620B1

(12) United States Patent
Fanslow

(10) Patent No.: US 11,087,620 B1
(45) Date of Patent: Aug. 10, 2021

(54) AUTOMATED FLAGGER SAFETY ASSISTANCE DEVICE

(71) Applicant: Safety Technologies, Inc., Red Wing, MN (US)

(72) Inventor: Charles E. Fanslow, Red Wing, MN (US)

(73) Assignee: Safety Technologies, Inc., Red Wing, MN (US)

( * ) Notice: Subject to any disclaimer, the term of this patent is extended or adjusted under 35 U.S.C. 154(b) by 0 days.

(21) Appl. No.: 16/773,012

(22) Filed: Jan. 27, 2020

(51) Int. Cl.

| | |
|---|---|
| ***G08G 1/056*** | (2006.01) |
| ***G08G 1/07*** | (2006.01) |
| ***G08G 1/095*** | (2006.01) |
| *E01F 9/70* | (2016.01) |

(52) U.S. Cl.
CPC ..... *G08G 1/07* (2013.01); *G08G 1/095* (2013.01); *E01F 9/70* (2016.02)

(58) Field of Classification Search
CPC ..... G08G 1/07; G08G 1/095; E01F 9/70
See application file for complete search history.

(56) References Cited

U.S. PATENT DOCUMENTS

| | | | | |
|---|---|---|---|---|
| 5,106,226 | A | 4/1992 | Fanslow et al. | |
| 5,493,292 | A | 2/1996 | Fanslow et al. | |
| 5,959,554 | A | 9/1999 | Armstrong et al. | |
| 6,134,819 | A | 10/2000 | McClain et al. | |
| 6,150,957 | A | 11/2000 | Henz et al. | |
| 6,198,410 | B1 | 3/2001 | White et al. | |
| 6,239,691 | B1 | 5/2001 | Preisler | |
| 6,407,675 | B1 | 6/2002 | Mumford et al. | |
| 7,333,029 | B2 | 2/2008 | Hammett | |
| 7,503,135 | B2 | 3/2009 | Chafin | |
| 8,164,483 | B1 | 4/2012 | Phillips | |
| 8,887,423 | B1 | 11/2014 | Morgan | |
| 9,601,012 | B2 | 3/2017 | Williams | |
| 9,765,490 | B1 | 9/2017 | Fanslow | |
| 9,972,205 | B2 | 5/2018 | Beaulieu | |
| 10,385,525 | B1 | 8/2019 | Pongracz | |
| 2010/0265088 | A1 | 10/2010 | Creech, Jr. | |
| 2019/0019408 | A1* | 1/2019 | Beaulieu | G08G 1/07 |
| 2019/0103022 | A1* | 4/2019 | Kelly | E01F 9/692 |
| 2020/0357280 | A1* | 11/2020 | Cade | G08G 1/0955 |

FOREIGN PATENT DOCUMENTS

| | | | |
|---|---|---|---|
| EP | 2355068 | A1 | 8/2011 |

* cited by examiner

*Primary Examiner* — Hongmin Fan
(74) *Attorney, Agent, or Firm* — Haugen Law Firm PLLP

(57) ABSTRACT

A method of installing and removing traffic control or traffic regulating devices. More particularly, the method includes the installation and removal of automated switchable road signs or flaggers. The safety assistance device and method in accordance with the invention envisions added safety for those installing and removing traffic control or automated flagger devices. Also, the safety assistance device and method of the invention is initiated without requiring a manual activation by those installing or removing the traffic control device.

13 Claims, 7 Drawing Sheets

30

AUTOMATED FLAGGER SAFETY ASSISTANCE DEVICE

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to installation and removal of traffic control or traffic regulating devices. More particularly, the invention pertains to the installation and removal of automated switchable road signs or flaggers. The safety assistance device in accordance with the invention envisions added safety for those installing and removing traffic control or automated flagger devices. Also, the safety assistance device of the invention is initiated without requiring a manual activation by those installing or removing the traffic control device.

BACKGROUND

Generally, during road construction various devices have been utilized to alert drivers to anticipate forthcoming road construction. By way of example, the road signs may indicate a lane merger or other traffic control. At times during road construction of two lane or more roadways it becomes necessary to reduce all lanes of traffic to a single lane for traffic travelling in opposing directions. In those situations traffic may be controlled travelling through the single lane by stopping the travel of traffic in a first direction and allowing traffic travelling in an opposing second direction through the single lane of roadway. After the second direction traffic passes through the single lane, subsequent travelers approaching the road restriction in the second direction will be stopped and then those that were travelling in the first direction and stopped will be allowed to travel through the single lane restriction. The stopping of traffic continues to alternate while the roadway is reduced to a single lane.

At times at least two road construction workers or flag persons may be utilized, one at each end of the section of the single lane roadway being controlled. A prior automated device has been described in U.S. Pat. No. 5,493,292 that is designed to eliminate the need to use individual control persons. The device provides a sign assembly that either displays the message "stop" or the message "slow." A sign assembly is positioned at each end of the restricted roadway and the assemblies are wirelessly synced so that one assembly displays "stop" while the other assembly displays "slow" or "stop". A remote transceiver may be utilized to control the display of each assembly.

Once a work zone is established, regulating traffic becomes more predictable. However, installing these Automated Flagger Assistance Devices (AFAD's) may prove challenging for the safety of the workers in high use roadways or in low light conditions. The potential safety hazard to the workers is greatest during the installation and removal periods because stepping out into the live lane of traffic may be required. Although lights have been utilized to illuminate the AFAD's when positioned at each end of a work zone, supplemental strobe lights that are activated during set up and take down of the AFAD's have not been utilized. Further, environmental conditions such as low light levels or direct sunlight may prevent a motorist from seeing a worker which could have a negative impact on the worker. The use of strobe lights during the installation and removal of AFAD's is expected to heighten motorist awareness. Although a strobe light with an on/off switch might be utilized, a simple on/off switch is dependent upon the worker or installer remembering to activate or deactivate the switch. Also, a simple on/off switch could require a worker to return to the device to turn it off once a second device is installed on the other end of construction.

Thus, it is desirable to provide an automated mechanism to illuminate a strobe on the traffic control sign during set up and takedown that does not have to be activated by the worker. Further, it is desirable to provide a mechanism that remotely automatically activates and deactivates a strobe associated with a traffic control sign.

SUMMARY

Embodiments according to aspects of the invention are incorporated into AFAD's. According to other aspects, the apparatus of the invention activates remotely. Further, the sequence of activation and deactivation may only be dependent upon initial activation of one of several AFAD's. The control of the strobe may also be implemented in other safety devices having strobes attached to them.

A method in accordance with aspects of the invention includes the steps of activating a remote transceiver having wireless capability; activating power to a first traffic control device that has capability to wirelessly interface with the remote transceiver, the first traffic control device having a first display mode and second display mode of the first traffic control device; determining if first traffic control device is active; illuminating a first strobe coupled to the first traffic control device when the first traffic control device is determined to be active; activating power to a second traffic control device that has capability to wirelessly interface with the remote transceiver, the second traffic control device having a first display mode and second display mode of the second traffic control device; determining if second traffic control device is active; and illuminating a second strobe coupled to the second traffic control device when the second traffic control device is determined to be active.

Particular embodiments of the invention may further include the step of determining whether both the first traffic control device is in the first display mode of the first traffic control device and the second traffic control device is in the first display mode of the second traffic control device. Additionally, the method may include the step of deactivating the first and second strobes when both the first traffic control device is in the first display mode of the first traffic control device and the second traffic control device is in the first display mode of the second traffic control device. The first traffic control device may be an Automated Flagger Assistance Device. Similarly, the second traffic control device may be an Automated Flagger Assistance Device. The method in accordance with aspects of the invention may further include the step of determining whether at least one of the first or second traffic control devices is deactivated. When at least one of the first or second traffic control devices is deactivated the first and second strobes are illuminated.

Another embodiment in accordance with the present invention that controls illumination of the strobe lights of a traffic control system includes the steps of activating a remote transceiver having wireless capability; activating power to a first traffic control device that has capability to wirelessly interface with the remote transceiver, the first traffic control device having a first display mode and second display mode of the first traffic control device; determining if first traffic control device is active; illuminating a first strobe coupled to the first traffic control device when the first traffic control device is determined to be active; and placing markers in the work zone.

Additionally, the method may include the step of determining whether the first traffic control device is in the first display mode of the first traffic control device. A further step includes deactivating the first strobe when the first traffic control device is in the first display mode. The first traffic control device is an Automated Flagger Assistance Device. A further step includes determining whether the first traffic control devices is deactivated. When the first traffic control device is deactivated the first strobe may be illuminated. This embodiment according to aspects of the invention may further include the steps of activating power to a second traffic control device that has capability to wirelessly interface with the remote transceiver, the second traffic control device having a first display mode and second display mode of the second traffic control device; determining if second traffic control device is active; illuminating a second strobe coupled to the second traffic control device when the second traffic control device is determined to be active. This method in accordance with the invention may further include the step of illuminating the first and second strobes when at least one of the first or second traffic control devices is deactivated. Further, the step may include determining whether both the first traffic control device is in the first display mode of the first traffic control device and the second traffic control device is in the first display mode of the second traffic control device. Additionally, this method may include the step of deactivating the first and second strobes when both the first traffic control device is in the first display mode of the first traffic control device and the second traffic control device is in the first display mode of the second traffic control device.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

Figure 1:
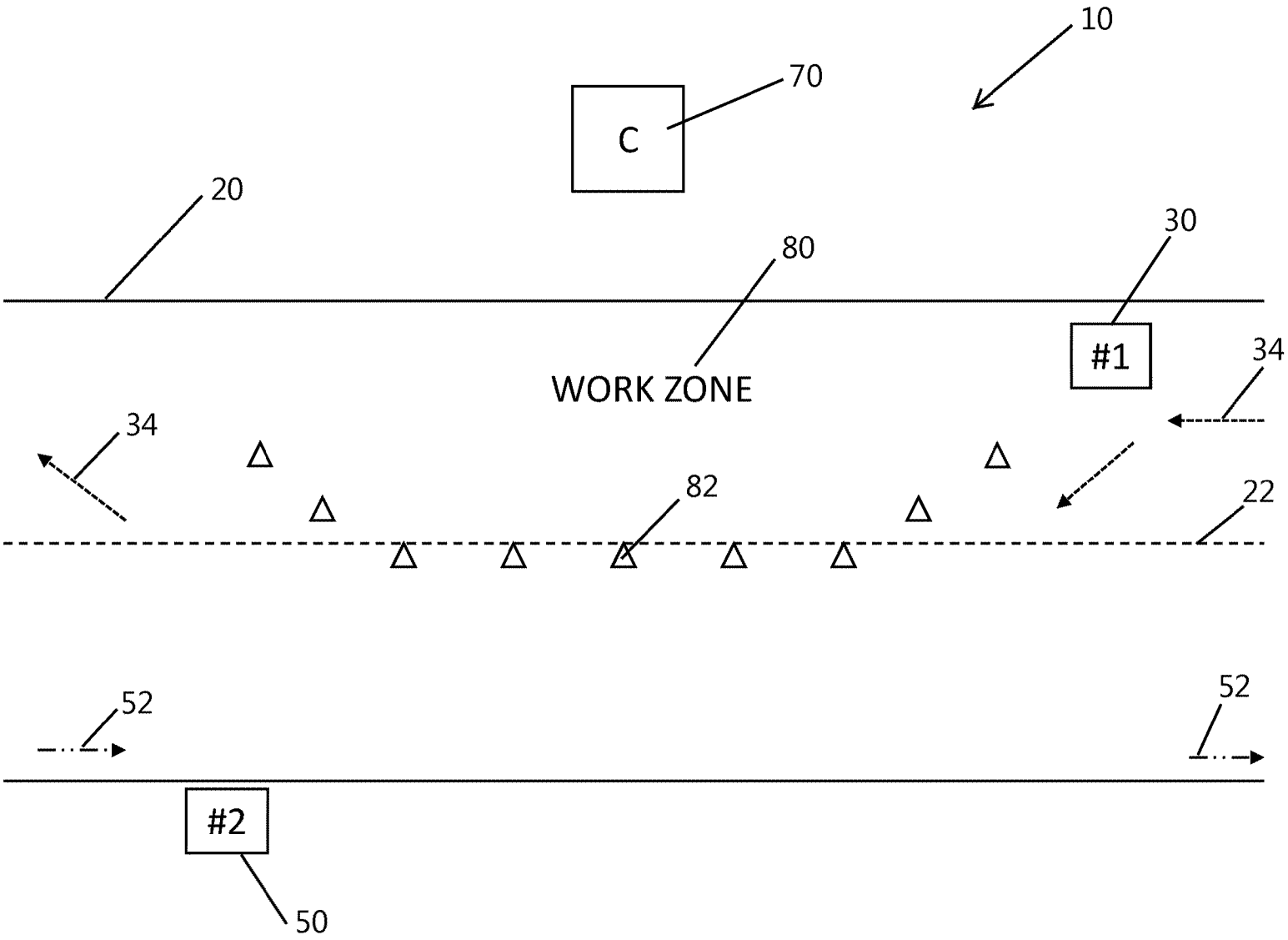
FIG. 1 is a schematic of a two lane roadway during construction that is particularly well suited for use of the method in accordance with the present invention.

The apparatus and method of the present invention is particularly well suited for autonomously controlling remote strobe lights attached to AFAD's. With reference to the Figures, various embodiments according to aspects of the invention will be described in greater detail. With reference to FIG. 1 a construction zone 10 on a two lane roadway 20 is generally depicted. The roadway and travel of traffic is divided with dotted line 22. A first traffic control 30 is positioned in the traffic lane of the first direction of traffic flow 34 prior to the work zone 80 and barriers or markers 82. A second traffic control 50 is positioned in the traffic lane of the second direction of traffic flow 52 prior to the work zone 80 and barriers or markers 82. The traffic controls 30 and 50 may be positioned near the shoulder of the roadway to increase visibility of the work zone while also alerting traffic to the controlled area. A controller or remote transceiver 70 may be wirelessly coupled to the traffic controls 30 and 50. Each traffic control 30 and 50 and controller 70 may be equipped with a solar panel power supply and the remote wifi. The wireless power switch control or remote wifi may further include antennas of known suitable construction. Without limitation intended, the wireless control may include wi-fi, z-wave or Bluetooth systems having hand held, key fob or switch controllers. Operating system apps may also be utilized to create additional functionality for the controller.

Figure 2:
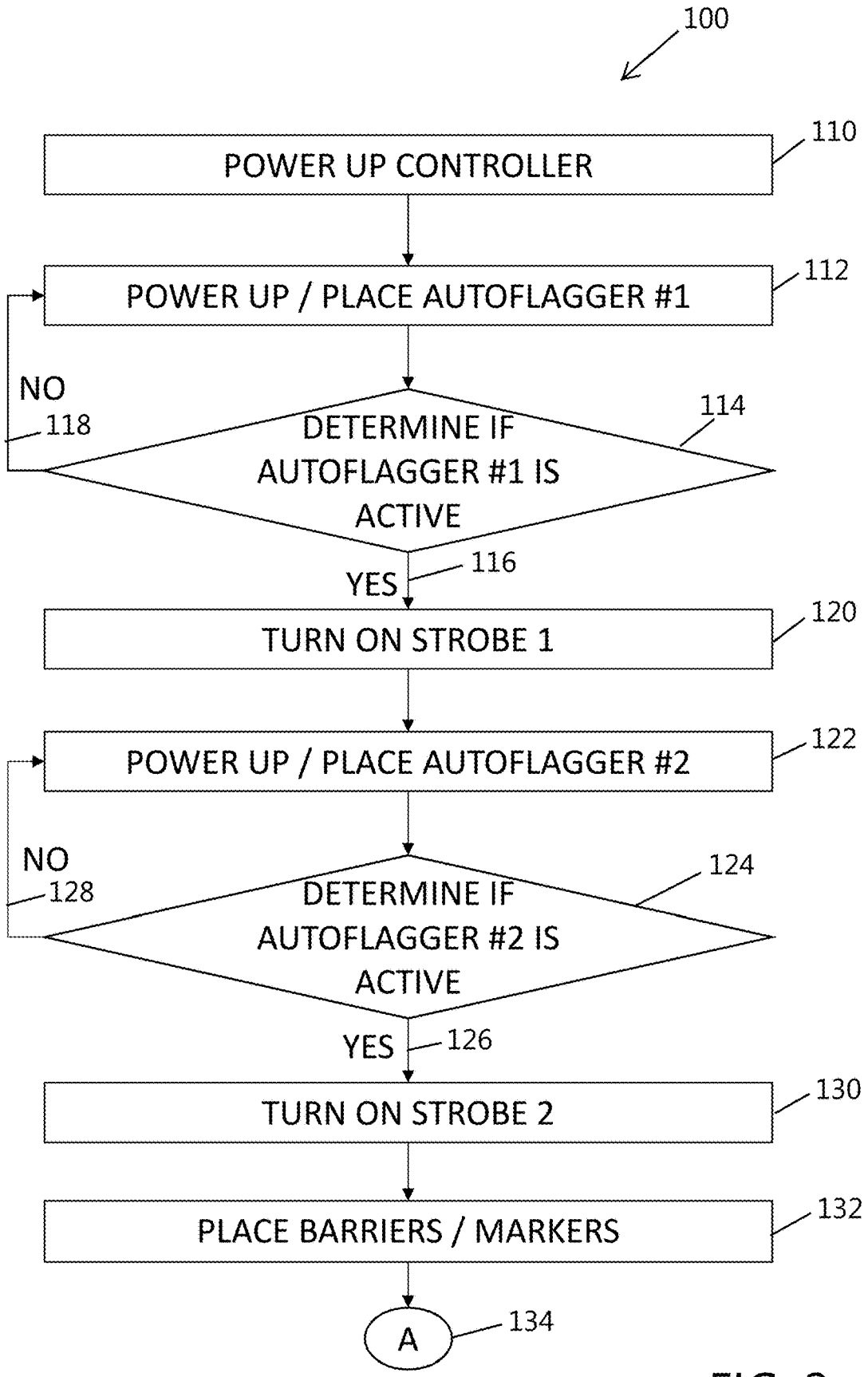
FIG. 2 is a first portion of a flow chart demonstrating a portion of the method in accordance with the present invention.
Figure 3:
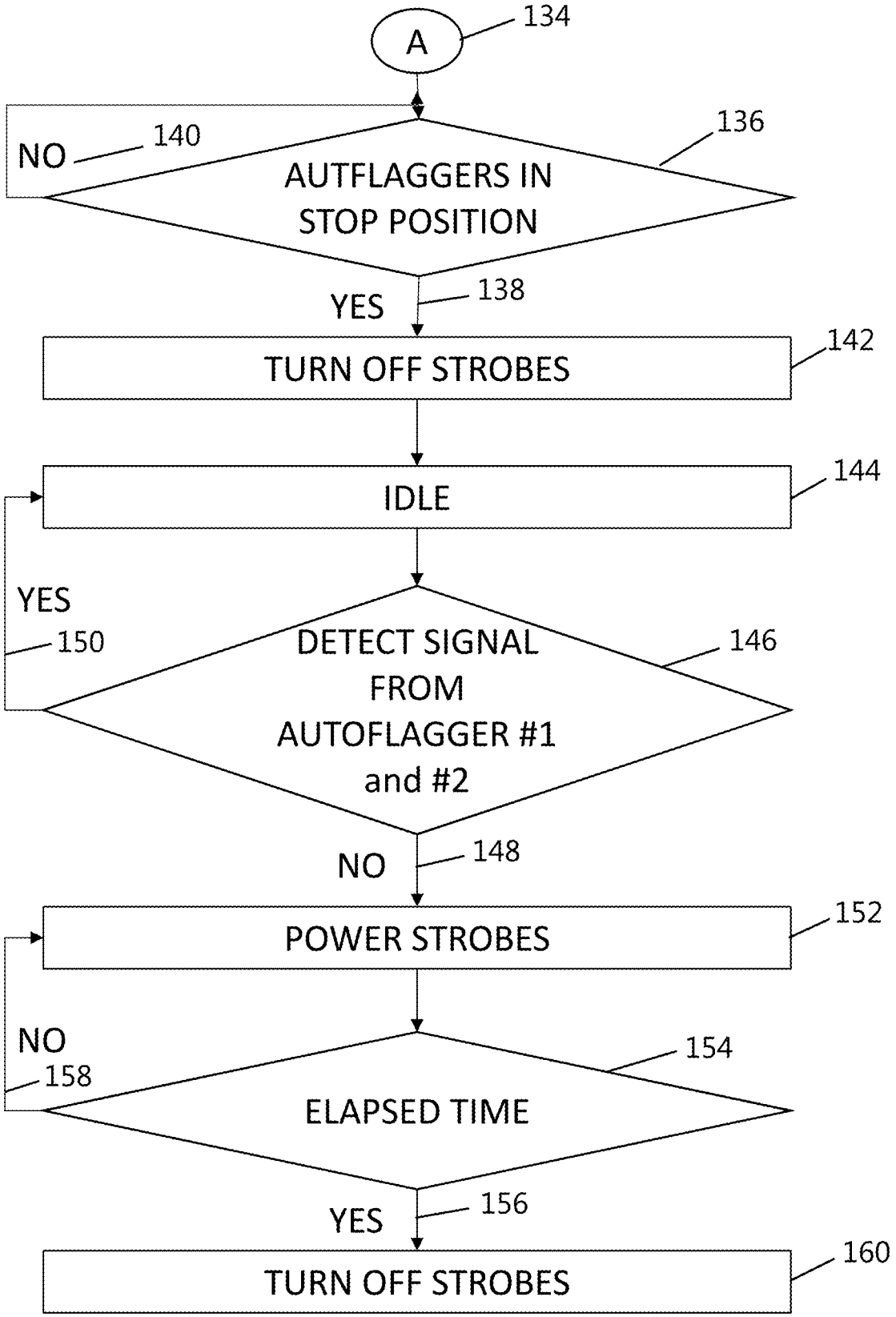
FIG. 3 is a second portion of a flow chart demonstrating a portion of the method in accordance with the present invention.

Referring to FIGS. 2 and 3, the method 100 for automatic operation of strobe lights attached to the first and second traffic control 30 and 50 in conjunction with the use of controller 70 will be described in greater detail. Once a construction zone 10 is identified and a traffic control plan is established the workers may install signage to alert traffic approaching the work zone from both directions of upcoming traffic regulation. Prior to installing AFAD's the power supply to the controller 70 is activated 110. A worker then supplies power to the first traffic control 30 and the traffic control 30 is moved into position. Controller 70 determines when the traffic control 30 is powered and becomes active 114. When activation of traffic control 30 is determined 116, a first strobe coupled to the power supply of traffic control 30 is activated or turned "on" 120. If the controller 70 does not sense activation of the first traffic control then the controller continues monitor for activation of the first traffic control; see loop 118. Once the worker installs the first traffic control the second traffic control 50 may be powered up and installed 122. Of course, multiple co-workers may work in unison to install the first and second traffic controls 30 and 50 at approximately the same time. The controller 70 will independently detect activation of each traffic control. Controller 70 determines if the second traffic control has been activated 124. When the controller determines the second traffic control has become active 126, a second strobe coupled to the power supply of the second traffic control is activated or turned on 130. The controller 70 continues to monitor for activation of the second traffic control as at loop 128. Once both traffic controllers are in place the workers may place markers or barriers 1332 to define the work zone 80 and provide guidance to the motorists.

The controller remains active and monitors the control signals to the traffic controllers 30 and 50; see flowchart connector 134 between FIGS. 2 and 3, decision 136 and loop 140. When both traffic controllers 30 and 50 are in the "stop" position, then the controller deactivates 142 or turns off the first and second strobes associated with the first and second controllers 30 and 50. The controller 70 remains active in and idle mode, 144 and loop 150, and continues to monitor power or deactivation of the traffic controllers 30 and 50; see decision 146. When power is turned off or deactivated to either of the traffic controllers 148 then the controller 70 activates or powers up the first and second strobes 152. The controller 70 includes a timer that keeps the strobes powered a sufficient time to allow workers to remove the traffic controllers 30 and 50 from the work zone; see decision 154 and loop 158. Once the preset time has elapsed 156 the controller again deactivates the strobes 160.

Figure 4:
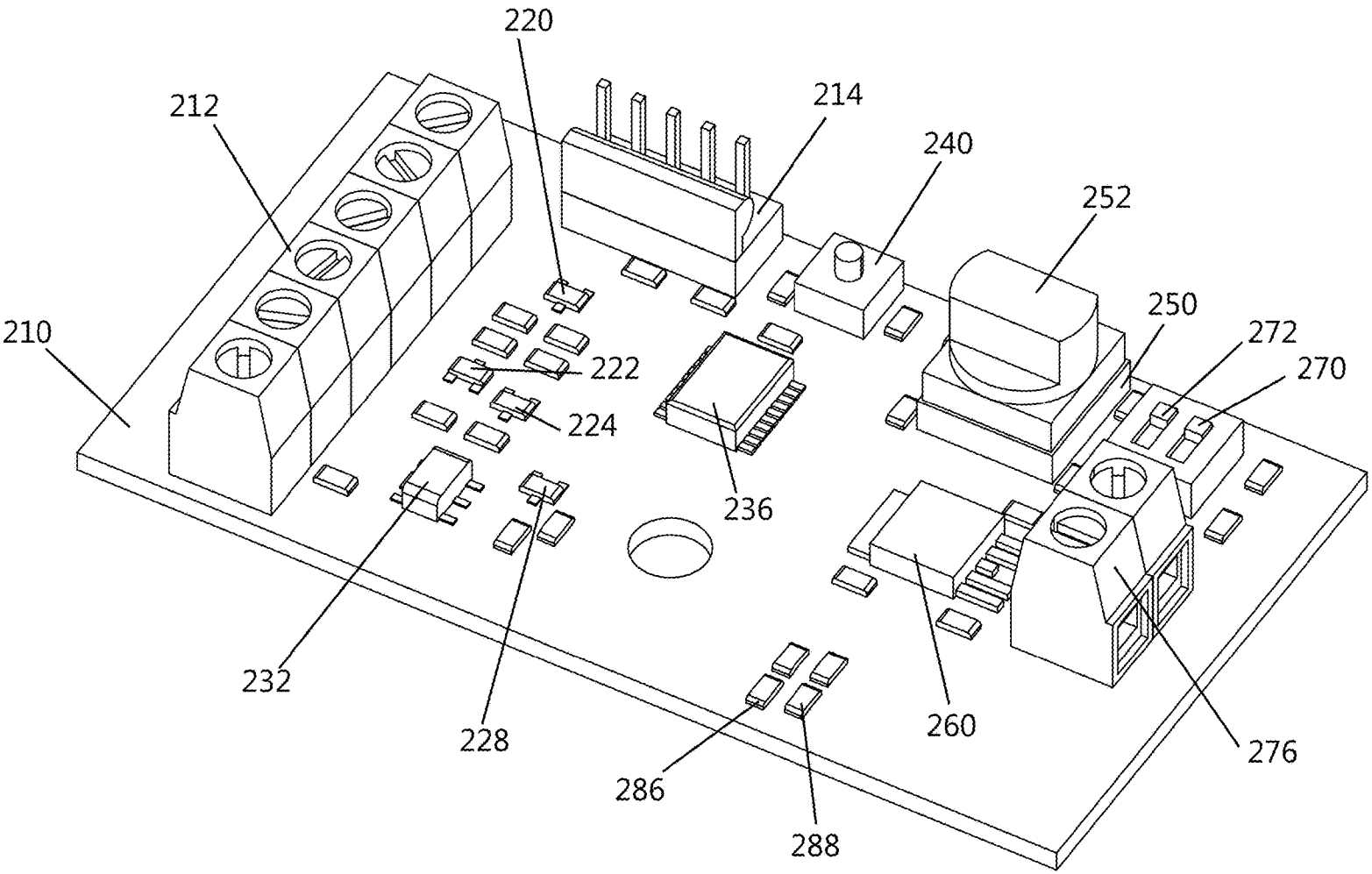
FIG. 4 is a perspective of a control board capable of implementing the method of the present invention.
Figure 5:
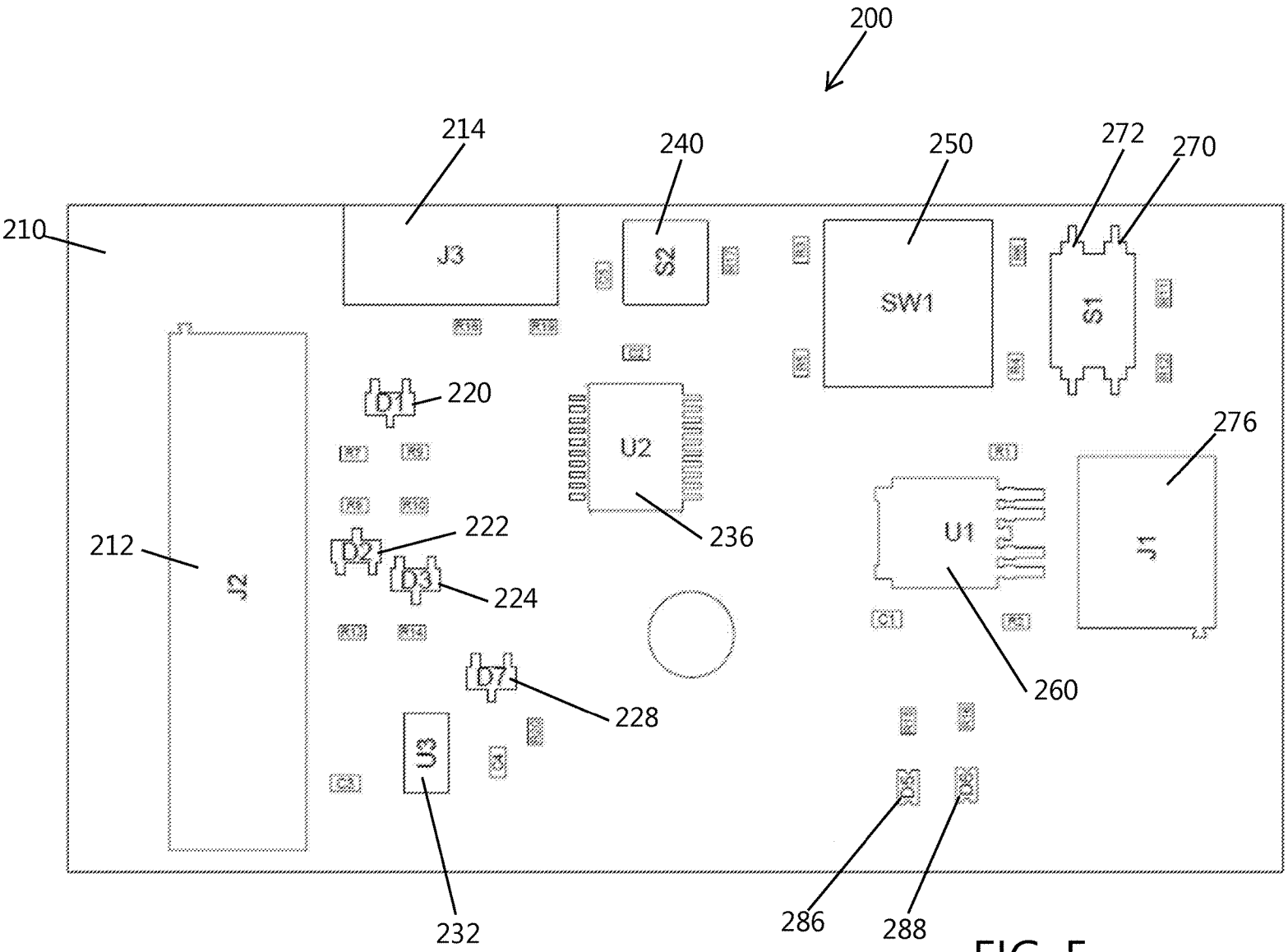
FIG. 5 is top schematic view a control board of the present invention capable of implementing the method of the present invention.
Figure 6:
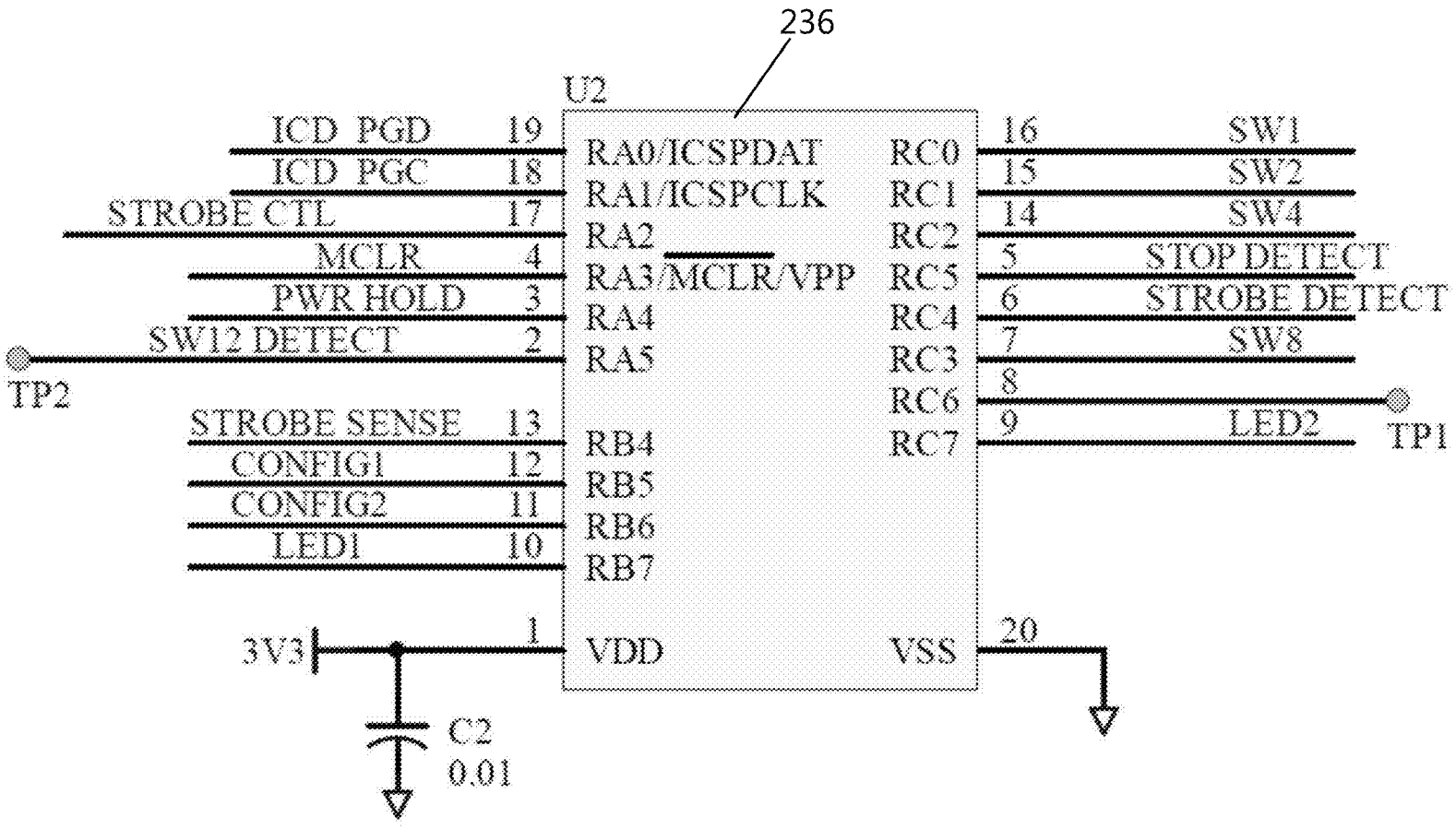
FIG. 6 is a schematic of a portion of the controller of the present invention and FIG. 7 is a perspective view illustrating an exemplary automated flagger assistance device or autoflagger traffic control device.
Figure 7:
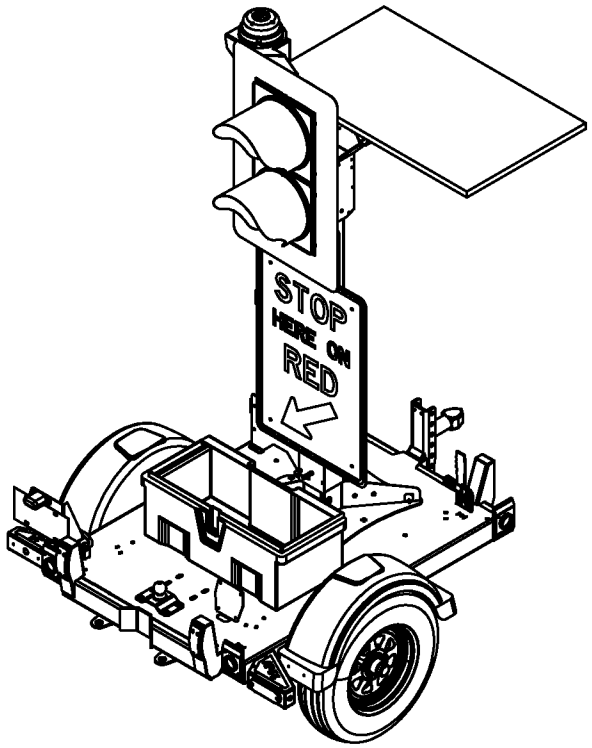

With reference now to FIGS. 4-6 the components of programmable control board 200 will be described in greater detail. Multiple boards 200 may be coupled to the traffic controllers 30 and 50 and controller 70 and may be programmed (as host and slave) to perform the above described functions. Each control board 200 may include IC board 210 to which components are electrically coupled. Electrical junction 212 includes electrical inputs from power supplies, the strobes and the traffic controller. Electrical junction 214 provides electrical interconnection between external control software and programming chips. Electrical junction 276 provides electrical connection between the strobes and strobe control chip 260. Shottkey diodes 220, 222, 224, and 228 are used in conjunction with power to various activity detectors. Programmable process control chip 236 and power chip 232 are coupled to the various electrical components to allow control of the strobes in accordance with the above described process. Timing switch 250 and knob 252 allow a user to control the amount of time the probes remain activated when the AFAD's are being removed. Detent switch 240 and configuration switches 270 and 272 allow a user to manually control the implemented configuration controlling activation and deactivation of the strobes. Diodes 286 and 288 are electrically coupled to green and red LED's that are coupled to process chip control 236. Those skilled in the art will appreciate that modifications may be made to control board 200 to further implement the control of strobes during the installation and removal of road construction safety devices without parting from the scope of the invention.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A method for controlling illumination of lights of a traffic control system, the method including steps of:

activating a remote transceiver having wireless capability;

activating power to a first traffic control device positioned adjacent a work zone, wherein the first traffic control device has capability to wirelessly interface with the remote transceiver, the first traffic control device having a first display mode and second display mode of the first traffic control device;

determining if first traffic control device is active;

illuminating a first strobe light coupled to the first traffic control device when the first traffic control device is determined to be active; and placing markers in the work zone.

2. The method as recited in claim 1, further including a step of determining whether the first traffic control device is in the first display mode of the first traffic control device.

3. The method as recited in claim 2, further including a step of deactivating the first strobe when the first traffic control device is in the first display mode.

4. The method as recited in claim 2, wherein the first traffic control device is an Automated Flagger Assistance Device.

5. The method as recited in claim 3, further including a step of determining whether the first traffic control devices is deactivated.

6. The method as recited in claim 5, further including a step of illuminating the first strobe when the first traffic control device is deactivated.

7. The method as recited in claim 1, further including steps of activating power to a second traffic control device that has capability to wirelessly interface with the remote transceiver, the second traffic control device having a first display mode and second display mode of the second traffic control device;

determining if second traffic control device is active;

illuminating a second strobe coupled to the second traffic control device when the second traffic control device is determined to be active.

8. The method as recited in claim 7, wherein the second traffic control device is an Automated Flagger Assistance Device.

9. The method as recited in claim 7, further including a step of determining whether at least one of the first or second traffic control devices is deactivated.

10. The method as recited in claim 9, further including a step of illuminating the first and second strobes when at least one of the first or second traffic control devices is deactivated.

11. The method as recited in claim 7, further including a step of determining whether both the first traffic control device is in the first display mode of the first traffic control device and the second traffic control device is in the first display mode of the second traffic control device.

12. The method as recited in claim 11, further including a step of deactivating the first and second strobes when both the first traffic control device is in the first display mode of the first traffic control device and the second traffic control device is in the first display mode of the second traffic control device.

13. The method as recited in claim 12, further including a step of determining whether at least one of the first or second traffic control devices is deactivated.

* * * * *